US005878667A

United States Patent [19]

Ryan

[11] Patent Number: 5,878,667

[45] Date of Patent: Mar. 9, 1999

[54] METHOD AND APPARATUS FOR DISPENSING INK TO A PRINTING PRESS

[75] Inventor: Garth S. Ryan, Alburg, Vt.

[73] Assignee: Walter Stobb Associates, Inc., Naples, Fla.

[21] Appl. No.: 871,554

[22] Filed: Jun. 10, 1997

[51] Int. Cl.[6] ..... B41F 31/08

[52] U.S. Cl. ..... 101/366; 101/484

[58] Field of Search ..... 101/366, 350.1, 101/365, 148, 483, 484; 118/24, 25, 688, 259

[56] References Cited

U.S. PATENT DOCUMENTS

| | | | |
|---|---|---|---|
| 3,199,451 | 8/1965 | Nitchie | 101/366 |
| 3,667,500 | 6/1972 | Stone | 137/386 |
| 3,780,651 | 12/1973 | Black et al. | 101/115 |
| 3,848,529 | 11/1974 | Gegenheimer et al. | 101/366 X |
| 4,155,304 | 5/1979 | Schweisser | 101/366 |
| 4,241,656 | 12/1980 | Smith | 101/148 |
| 4,277,791 | 7/1981 | Rosenstock et al. | 346/140 |
| 4,535,693 | 8/1985 | Belvederi | 101/366 |
| 4,699,054 | 10/1987 | Scrudato et al. | 101/330 |
| 4,787,313 | 11/1988 | Osborn | 101/366 |
| 4,852,604 | 8/1989 | Wales et al. | 137/392 |
| 5,060,826 | 10/1991 | Coleman | 222/95 |
| 5,103,728 | 4/1992 | Barney | 101/364 |
| 5,239,925 | 8/1993 | Bobo | 101/366 |
| 5,505,126 | 4/1996 | Ohno et al. | 101/147 |

*Primary Examiner*—J. Reed Fisher
*Attorney, Agent, or Firm*—Arthur J. Hansmann

[57] ABSTRACT

A method and apparatus for dispensing ink to an ink fountain of a printing press. A flexible bag of ink is utilized and is compressed for forcing the ink into the fountain, and a sensor determines the level of ink in the fountain and thus controls the force on the bag, that is, the compressor on the bag.

25 Claims, 6 Drawing Sheets

28
37
46
38
34
39
36
48
41
42
47
43
44
28
84
77
83
79
78
86
82
81

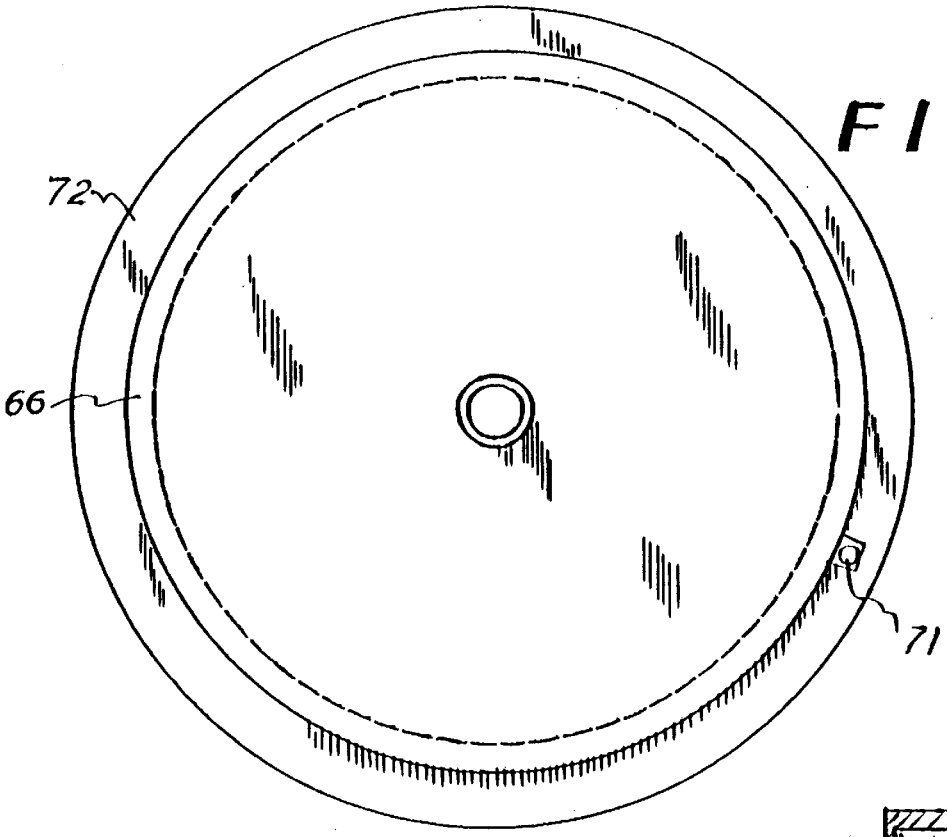
FIG. 5
FIG. 8
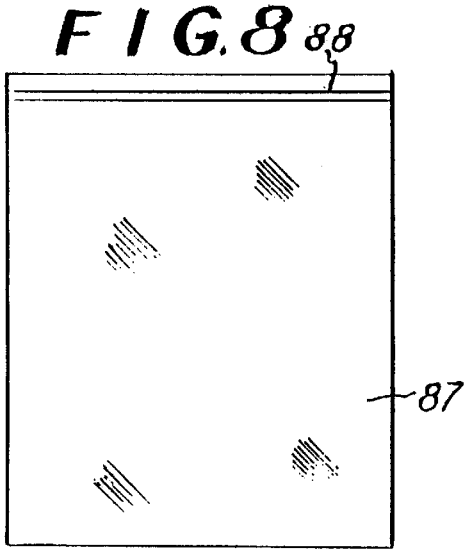
FIG. 9
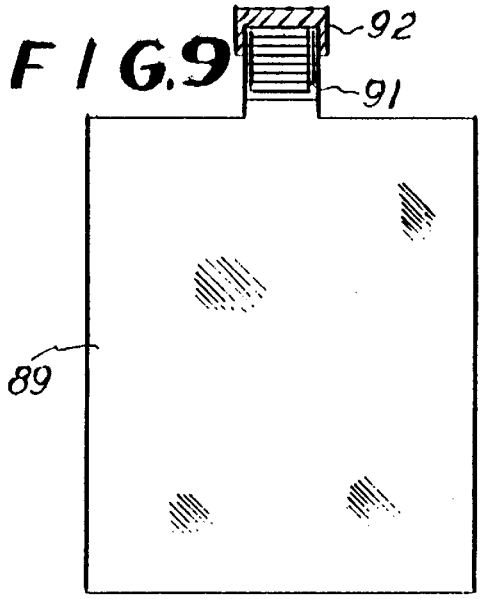

28
22
37
23
16
32
33
31
74
58
76

METHOD AND APPARATUS FOR DISPENSING INK TO A PRINTING PRESS

This invention relates to both the method and apparatus for dispensing ink to a printing press. More particularly, it relates to the method and apparatus for dispensing ink to a printing press wherein the ink is fully confined to its dispensing location and the printing press ink fountain, and the apparatus is readily cleanable and a variety of different ink colors can be dispensed with intermittent cleaning.

BACKGROUND OF THE INVENTION

In the presently established manners of dispensing printing press ink, the ink may be commonly taken from a rigid container and dispensed into the fountain, and this can be done manually. In some of the prior art arrangements, the ink would be supplied to the press fountain manually, and the original ink containers would necessarily be left for the ink therein to dry out and not be usable. This, and other manners, represent the prior art and are found to be time consuming, unclean, wasteful with ink, and requiring constant monitoring by the press operator. In some instances, such as that shown in U.S. Pat. 4,699,054, there is the utilization of a bag of ink which feeds, but only by gravity, into a cartridge for the movement of the ink. Printing press ink does not readily respond to gravity flow, and in the aforesaid prior art, the cartridge and its connecting parts were necessarily employed and normally become wasted parts since they cannot be cleaned and reused.

The prior art is also aware of the employment of a sensor in the printing press ink fountain for determining the level of ink in-the fountain, and the sensor may be connected to a computer which controls an ink pump for supplying ink to the fountain. Such an arrangement is that which is shown in U.S. Pat. No. 4,852,604. In that arrangement, the ink is dispensed from tanks which are connected to the fountain, and pumps are employed for moving the ink from the tank to the fountain. The arrangement is such that the tanks must be completely emptied after each print run, or the remaining ink in the tank is to be wasted, and the tanks must be specially cleaned, including the connecting lines, before refilling the tank and, of course, before changing the color of the ink.

The present invention improves upon the prior art in that it provides a method and apparatus for dispensing ink to a printing press and doing so in a manner wherein the ink is initially contained in a flexible dispensing bag and is directed to the press fountain in a simplified, automated, and reliable arrangement. More specifically, the ink is dispensed by means of sensing the level of ink in the fountain and correspondingly activating a dispenser which causes the ink to flow from the flexible bag and into the fountain. As such, there is no requirement for pumps, valves, and also no requirement for manual operations and attendance because the entire arrangement is automated, and uses only a solenoid valve.

The present invention also includes a provision and utilization of a flexible ink-containing bag which renders the entire arrangement self-contained and thus clean with regard to the handling of the ink. Other parts of the system are also arranged for easy cleaning and thus expediting the maintaining of the equipment in clean condition and the changing of the operation to different colors of ink.

Still further, the present invention provides for the handling of printing press ink in a manner wherein the operation can be interrupted at any time and the quantity of ink yet to be dispensed, such as that in the flexible bag, can be readily preserved, including the removal of the bag from the remainder of the apparatus. Also, the present arrangement is such that bags of varying sizes can be accommodated. Also, the bags can be completely evacuated in only the normal course of operation.

Another specific object is the arrangement of the dispensing system wherein the system transporting the ink can be readily cleaned at the appropriate time, and such convenience is established by having the components of the system easily disassembled for the cleaning.

Additionally, an object is to provide a flexible bag supplying the ink, and to arrange that the bag is evacuated of its ink directly into the ink fountain, that is, without the need for any interconnecting parts or method steps between the bag and the fountain.

Further, there is the provision of the parts and method steps whereby an ink dispenser manifold is disposed directly above the fountain and distributes ink evenly into the fountain, and it utilizes a distribution nozzle outlet which restricts the ink flow to impart shear to the ink to improve flow by breaking the Thixotropic nature of printing ink. The Thixotropic nature of ink causes it to resist flow if it is stationary for a while, so it is preferred to pressurize it to initiate the flow, otherwise, it has a very high vicosity.

Also, the arrangement is such that there is a direct indication of the quantity of the ink in the bag, at any point in the operation. Further, when no further ink is to be moved through the system, then there can be an evacuation of the remaining ink and thereby preliminarily clean or evacuate the ink from the system simply by utilizing the system in its normal arrangement.

BRIEF DESCRIPTION OF THE DRAWINGS

FIG. 5 is an elevational view of another embodiment of the container part, partly in section.

FIGS. 8 and 9 are view of two different arrangements of the flexible bag useful in this invention.

DETAILED DESCRIPTIONS OF THE PREFERRED EMBODIMENTS AND METHOD

The description and drawings with regard to the apparatus is also a disclosure of the method and it should be understood as such.

Figure 1:
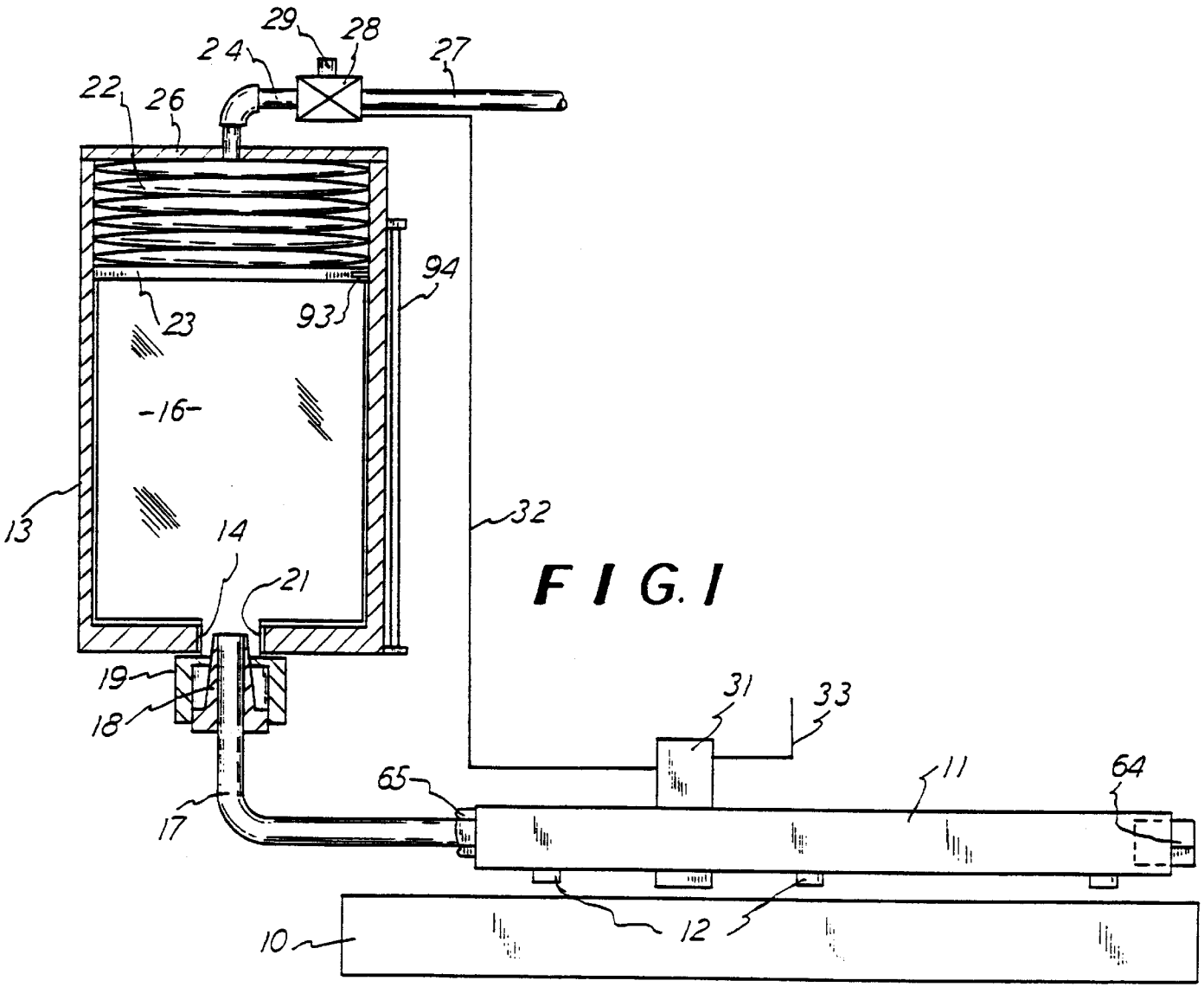
FIG. 1 is an elevational view of one embodiment of this invention, partly in section.

FIG. 1 shows an embodiment with an ink fountain 10 which can be of a standard nature and which supplies the ink to a printing press which is also of a standard nature, but is not shown herein and these parts will be understood to anyone skilled in the art. As such, the fountain 10 is upwardly open along the fountain 10 for the full length shown. A manifold 11 is suitably mounted directly above the fountain 10 and has nozzles 12 which are directed downwardly and can direct the flow of ink from the manifold 11 and into the fountain 10. In some arrangements, the actual nozzles 12 can be omitted and a simple formed or tapered type of outlet can exist on the manifold 11, as shown in other drawings.

A rigid container 13 has a lower opening 14 and supports a bag 16 containing the supply of ink, and that bag may be of varying size while the container 13 is of one size. A pipe 17 is suitably connected to the manifold 11 and to the container 13 so that the ink from the bag 16 can be directed into the manifold 11. For that connection, there can be a tapered connector 18 and a threaded nut 19 which mounts on the container and the tapered nut seals with the nut 19, and the lower end of the bag 16 has a mouth and opening 21 which is extended into the container opening 14 and is sealed therewith by the connectors 18 and 19 which can be of a conventional type of threaded nut quick-connect and disconnect.

To apply pressure to the bag 16, FIG. 1 shows an air bellows 22 contained in the upper end of the container 13, and there is a piston 23 therebelow. An air connector 24 connects through the tank top 26 and to the bellows 22 and thus can apply air pressure into the bellows 22 to expand the bellows and press the piston 23 downwardly onto the bag 16 to evacuate the bag and cause the ink therein to flow out of the container 13 and into the pipe or passageway 17 and into the manifold 11 and eventually fall by gravity into the fountain 10, as is inherent in the showing.

The compressed air enters the pipe 24 and thus the bellows 22 from a pipe 27 and through a solenoid valve 28. The supply of air for the pipe 27 is standard in a printing plant, and is thus available for conducting compressed air into the pipe 27 and to the solenoid 28. A room air relief port 29 is on the solenoid 28.

The solenoid 28 can be normally open, and it connects to an ink level sensor 31 operative on the fountain 10 to determine the level of ink in the fountain. A wire connection 32 extends from the sensor 31 to the solenoid 28 to activate the solenoid 28 according to the demands of the sensor 31 and thus cause the bellows 22 to exert pressure on the bag 16 for the dispensing of ink into the fountain 10. An electric power supply line 33 is shown connected to the sensor 31. Also, the bellows 16 can be a spring return type so that when the air pressure is relieved, the spring will cause the return action, as is well known.

Figures 2, 7:
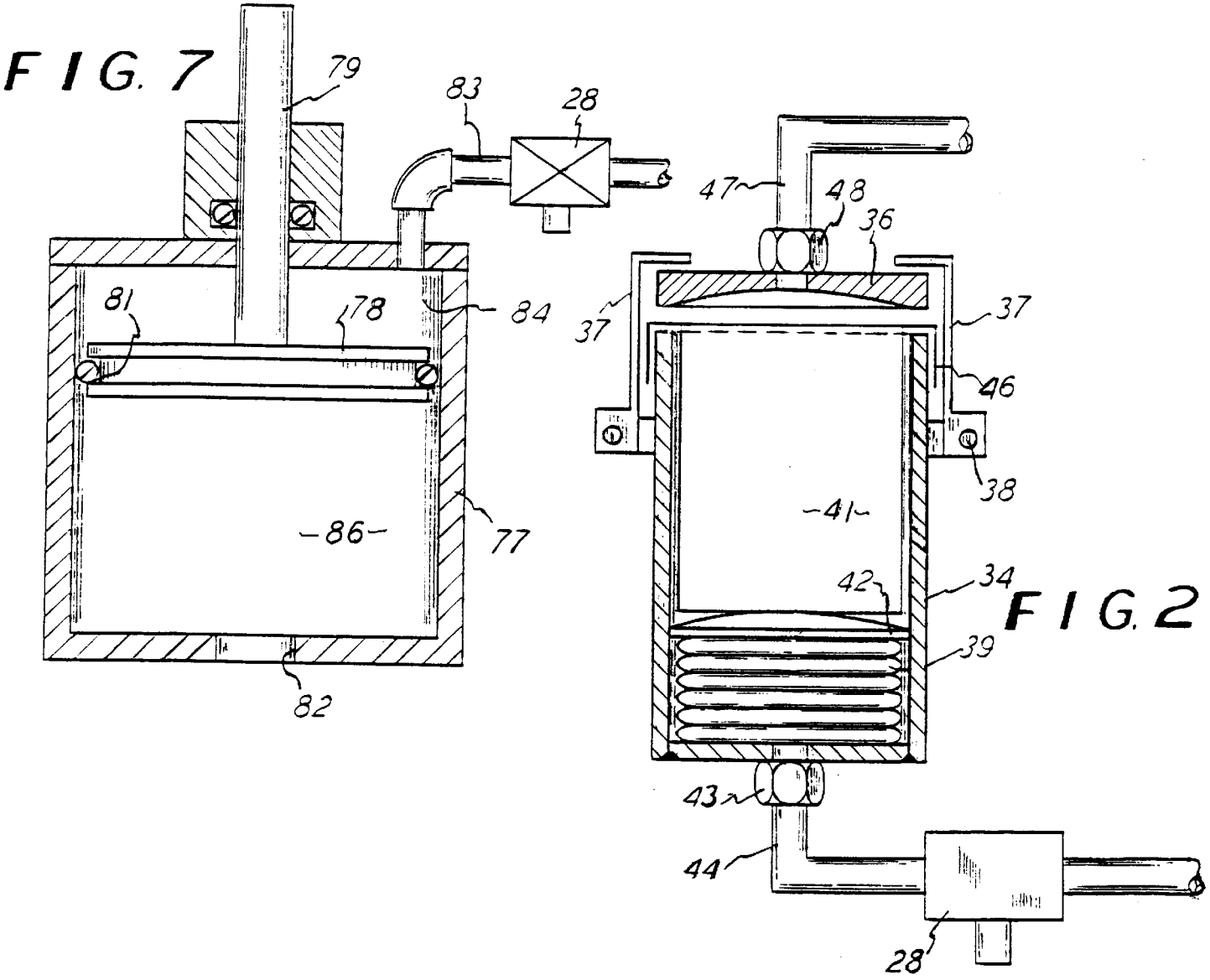
FIG. 2 is an elevational view of another embodiment of this invention, partly in section.
FIG. 7 is a sectional view of another embodiment of this invention.

FIG. 2 shows a somewhat different embodiment, and here it will be seen that there is a container 34 which has a lid 36 held tightly thereon by means of latches 37 hinged to the container 34 at hinges 38. In this instance, there is a bellows which is bellows 39 and it is below the ink bag 41 and thus presses upwardly on the bag 41 through the piston 42. In that embodiment, the solenoid 28 is below, and there is a ready release, but standard type of pipe, connecting nut 43 on the air inlet line 44 for pressurizing the bellows 39, as desired according to the sensor 31 in the fountain 10. The upper portion of the bag 41 has its upper end 46 open and draped over an upper edge of the container 34, and the cover 36 bears downwardly thereon to make it airtight with respect to the container 34, and thus the ink is forced upwardly and out the outlet 47 which is suitably, but quickly detachable from the tank lid 36 by means of the nut 48, and the pipe 47 leads off to the manifold, such as the manifold 11.

Figure 3:
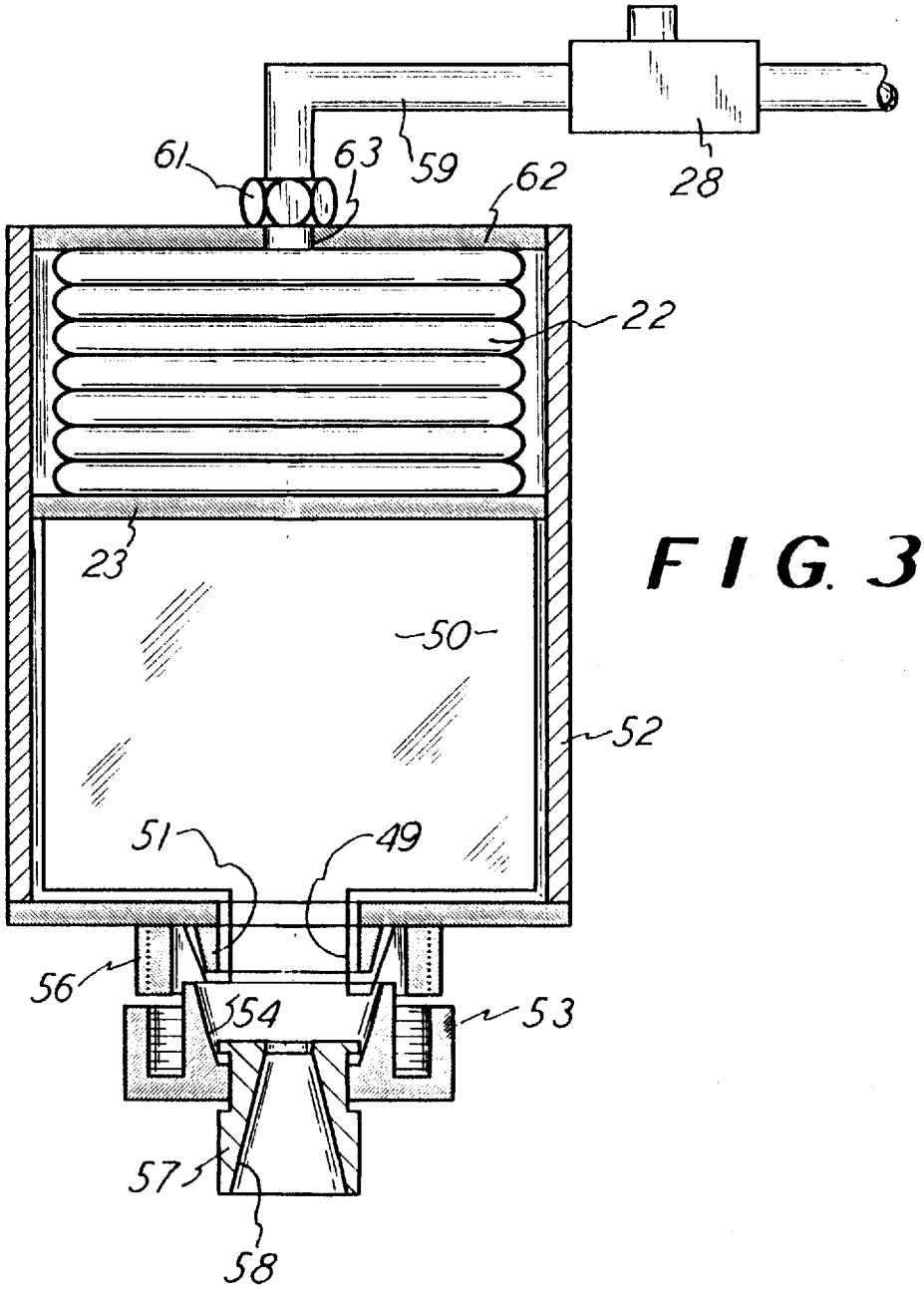
FIG. 3 is an elevational view of another embodiment of the invention, partly in section.

FIG. 3 also shows an embodiment which is akin to FIG. 1 in that the bellows 22 is above the ink bag now designated 50, and the bag 50 has its lower mouth or opening 49 draped over a conical extension 51 on the container 52. A threaded nut 53 fits up against the outer taper of the extension 51 and it too has a taper 54 for engaging the bag mouth 49 and pressing it against the container extension 51 for airtight seal therewith. Of course, the nut 53 threads onto a cylindrically-threaded extension 56 on the container 52. A nozzle 57 is trapped with the nut 53 and has the outwardly conically-flared outlet opening 58 for the passage of the printing ink therethrough and thus the accommodation of the Thixotropic nature of the ink. FIG. 3 also shows the air inlet pipe 59 and the quick-disconnect nut 61 connecting the pipe 59 to the container top 62 and it aligns with the container top inlet opening 63.

FIG. 1 shows that in these arrangements the manifold 11 can be provided with an end-threaded plug 64 and a quick-connect nut 65, both of which can be readily removed for cleaning purposes.

Also, due to the high viscosity of the printing ink, the bags 16 and 50 can be inverted without ink moving therefrom and arranging them for the quick-disconnect nut shown in FIGS. 1 and 3.

Figure 4:
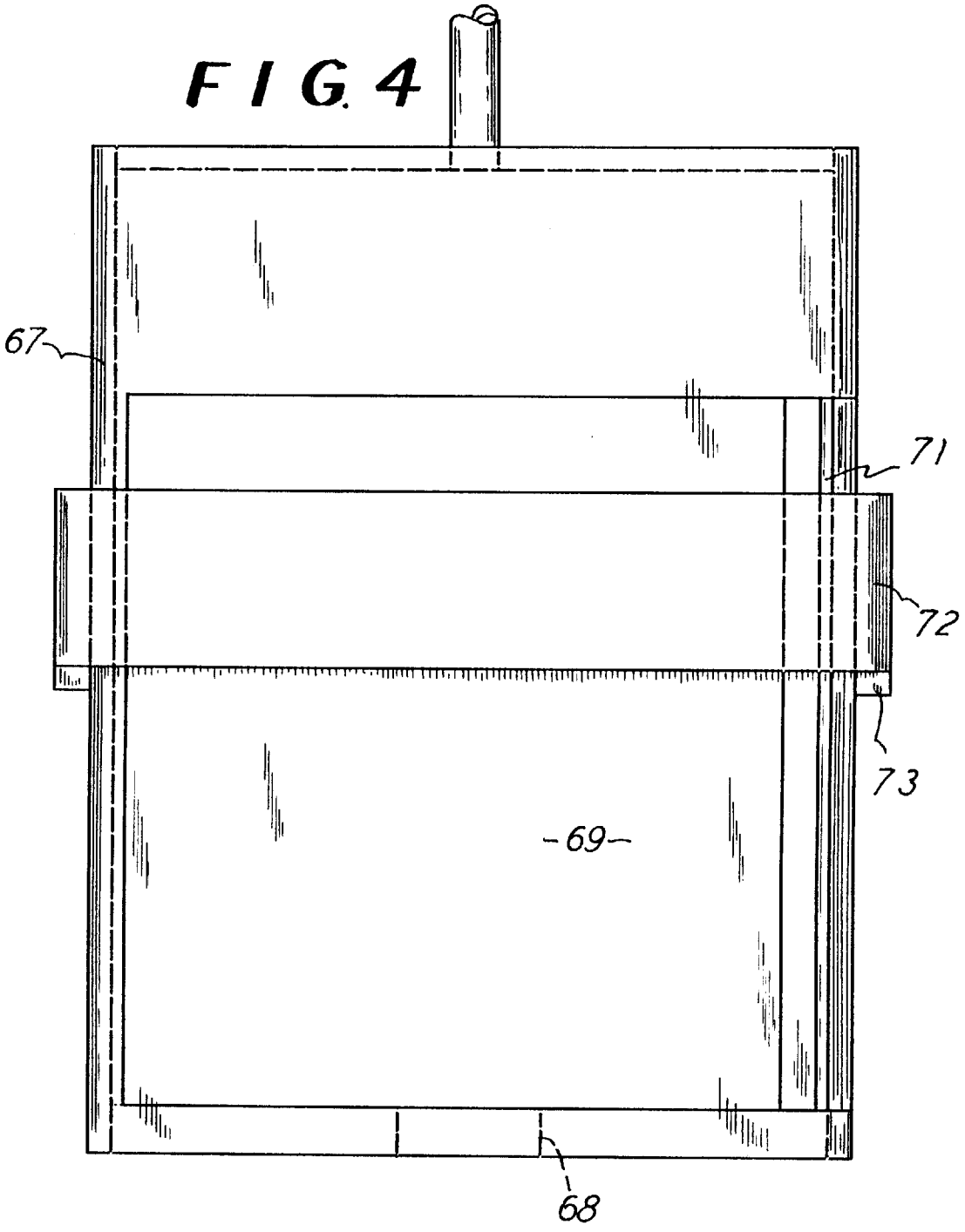
FIG. 4 is an enlarged top plan view of the container part shown in the previous figures.

FIG. 4 shows a container 67 which is cylindrical and which has a lower opening 68 for the outlet connections mentioned. Also, it has a side opening door 69 which permits interior access into the cylindrical container 67 for insertion and removal of an ink bag. There can be a standard door hinge 71 for opening and closing the door 69, and a complete ring 72 extends around the container 67 for holding the door 69 tight with the remainder of the container 67. The ring 72 can slide to the top of the container 67, and ring supports or stops 73 on the container 67 will position the ring 72 in the door-secured position shown.

FIG. 5 shows the top view of the type of container of FIG. 4, and it is preferred that all of the containers shown herein are of a cylindrical shape.

Figure 6:
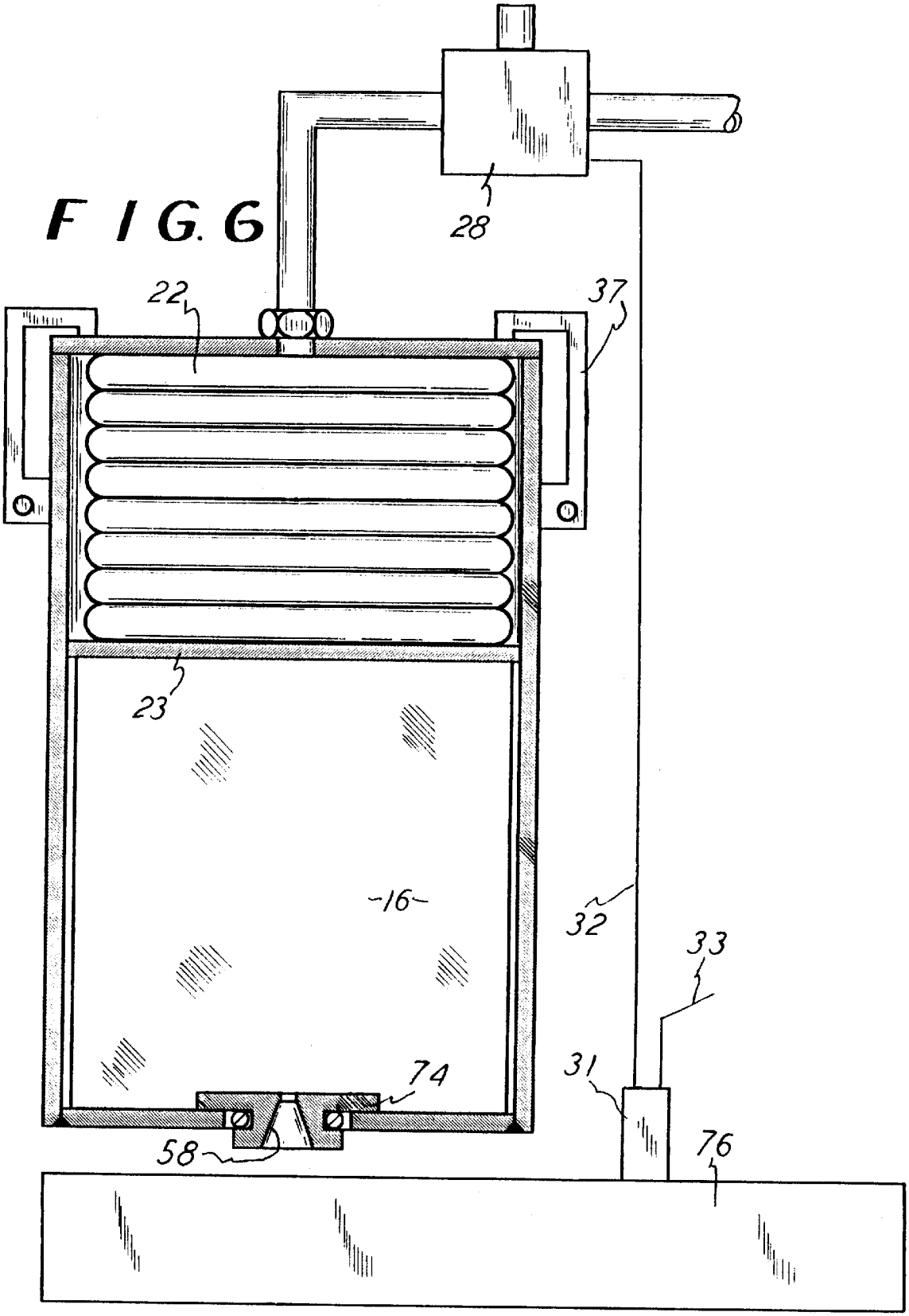
FIG. 6 is an elevational view of another embodiment of this invention.

FIG. 6 shows an arrangement similar to FIG. 3, and in both instances the nozzle 57 and FIG. 6's nozzle 74 have their conically-shaped outlet and, as seen in FIG. 6, the fountain designated 76 is directly below the nozzles 57 and 74, and thus there is no need for the connector such as the pipe 17 and the manifold 11 seen in FIG. 1. As with fountain 10, and conventionality, fountain 76 is upwardly open directly below outlet opening 58 for receiving ink from the bag 16 when the ink falls out of the bag 16, due to the force from the compressor 22. Of course there would still be the sensor 31 in the fountain 76 and it would be connected to the solenoid 28.

FIG. 7 shows a different embodiment for providing the compressor or the pressure applicator for the ink bag which would be in the container 77. In that instance, there is a piston 78 and a piston guide rod 79, and an O-ring 81 extends around the piston 78 and engages the inner circular wall of the container 77. The bag would of course exhaust through the container outlet 82 in any manner such as that shown in the other drawings. The air pipe 83 connects directly to the upper chamber 84 of the container 77 to force downwardly on the piston 78 and thus onto the bag which would be in the lower chamber 86, and that would of course replace the bellows in the heretofore shown embodiments.

FIG. 8 shows an ink bag 87 which has a tongue-and-groove type of seam or sealer 88 of a conventional nature so that the bag can be sealed before and after it has been used, assuming that there is remaining ink in the bag, and it is to be preserved without excessive air in the bag.

Also, FIG. 9 shows a bag 89 which has a threaded neck 91 which serves as a bag spout, and a cap 92 threaded thereon so that the bag can be opened for removal of the ink and it can be closed for preserving the ink, as desired. In all instances, the bags shown herein are flexible bags and of course are sufficiently sturdy to contain the ink and cause it to flow outwardly through the bag openings as described herein.

FIG. 1 also shows that there are means and method for detecting the level of ink in the bag and that is accomplished by detecting the level of the piston, such as 23 in FIG. 1. The piston 23 has a magnet 93 embedded therein, and there is a magnetically responsive level sensor bar 94 mounted upright along the side of the container 13 and thus it detects the elevation of the magnet 93 and thereby shows the position of the piston 23 and thus the quantity of ink in the bag 16. The aforementioned inherently discloses the method which is that of confining the ink in a flexible bag and disposing it in the rigid container and then applying pressure to the bag to force ink out the outlet and directing that ink-flow to the fountain, whether it be direct to the fountain or to the manifold above the fountain, and there is also the sensing of the level of the ink in the fountain and the sensor connection to regulate the pressure on the bag according to the level sensing. Of course the method also includes the removal of the initial bag of ink and cleaning of the apparatus and then the insertion of another bag and repeating the process with the fresh bag of ink which may be of a color different from the initial bag of ink.

The flexible bag is of a pliable, plastic material which is fully collapsible upon itself to evacuate it of its ink. There may be a mouth or outlet in the bag before it is installed in the rigid container and the mouth or outlet is a spout and an outlet section, with a passageway, such as seen in FIGS. 1, 2, 3, and 9. The container in FIG. 7 is air tight and of a rigid construction to withstand the necessary pressure applied for evacuating the bag and it has a plurality of walls or sides which define an enclosure where the bag is located. Also, the ring 72 is used to avoid the use of door latches which can be weak.

What is claimed is:

1. An ink dispensing system for a printing press, comprising an ink fountain being open in the upward direction, a rigid container with a plurality of sides and having an outlet in a lowermost one of said sides and with said outlet being disposed directly above said fountain, a flexible bag of ink disposed in said container and having an ink-flow outlet section in the lowermost position thereon and being disposed adjacent said container outlet and being completely closed except for said outlet, said bag outlet section extending to a location directly above said fountain to drop ink into said open fountain, a compressor disposed in said container to be operative on said bag and arranged to compress said bag only from the exterior surface of said bag and against said container to cause the ink in said bag to fall through said outlet section and into said open fountain, and a level sensor adjacent said fountain and being arranged to detect the level of ink in said fountain and being operatively arranged to be effective between said fountain and said compressor to control the amount of ink falling into said open fountain and doing so in accordance with the level of ink in said fountain.

2. The ink dispensing system for a printing press as claimed in claim 1, wherein said compressor includes a piston slidable in said container and onto said bag so as to press on said bag to create pressure therein to force the ink out of said bag.

3. The ink dispensing system for a printing press as claimed in claim 1, wherein said bag and said line are both arranged to confine the ink free of contacting said container, and said bag outlet section being disposed beneath the remainder of said bag for gravity action to be exerted on said ink in said bag and to thereby urge said ink into said outlet section.

4. The ink dispensing system for a printing press as claimed in claim 1, including said container having an ink-flow outlet, and said fountain being disposed directly underneath said container outlet for receiving the ink directly from said bag.

5. The ink dispensing system for a printing press as claimed in claim 1, wherein said container outlet is frusto-conically shaped to flair at the location adjacent to said fountain and thereby overcome the thixotropic nature of the ink in its flow through said outlet.

6. The ink dispensing system for a printing press as claimed in claim 1, including a manifold fluid-flow connected with said bag outlet section receiving the ink and being disposed directly above said fountain to dispense the ink into said fountain.

7. The ink dispensing system for a printing press as claimed in claim 6 wherein said container and said bag outlet section and said manifold are all releasably threadedly connected together for ready disconnect for cleaning.

8. An ink dispensing system for a printing press, comprising an ink fountain having an upwardly facing opening for receiving ink, a rigid container disposed adjacent said fountain and having a plurality of sides with an outlet in one of said sides, a flexible bag of ink disposed in said container and having an ink-flow outlet section disposed relative to said container in an arrangement to have said outlet section in ink-flow with said container outlet and with said outlet section having an ink-flow passageway therethrough and being completely closed except for said passageway, said ink-flow outlet passageway of said bag being disposed lowermost on said bag and located relative to said fountain opening to be directly thereabove to drop ink into said fountain through said passageway, a compressor disposed in said container to be operative on said bag and being arranged to be free of contact with the ink therein and to force only on the exterior of said bag for compressing said bag within said container and against said one side thereof to cause the ink in said bag to fall through said outlet and into said fountain, and a level sensor adjacent said fountain and being arranged to detect the level of ink in said fountain and being operatively arranged to control said compressor and thereby control the amount of ink falling through said outlet and doing so in accordance with the level of ink in said fountain.

9. The ink dispensing system for a printing press as claimed in claim 8 wherein said compressor includes a piston slidable in said container and onto said bag so as to press on said bag to create pressure therein to force the ink out of said bag.

10. The ink dispensing system for a printing press as claimed in claim 8, including a detector disposed adjacent said container and being responsive to the quantity of ink in said bag in said container and being arranged to display the level of ink in said bag in said container.

11. The ink dispensing system for a printing press as claimed in claim 8, wherein said compressor includes a bellows for receiving air for creating the pressure on said bag.

12. A method of supplying ink to a printing press ink fountain, comprising the steps of placing ink into a flexible supply bag which is completely closed except for having an ink flow outlet section with an opening therein, confining said bag inside a rigid container having a bottom side with an outlet therein and to have said outlet section at the lowest side of said bag and adjacent said container outlet and thereby to be in an inverted position and being disposed directly above said fountain, applying only physical pressure and only onto the exterior of said bag to force said bag against said container and thereby force the ink to fall out said outlet opening of said bag, directing the fall of the ink into said fountain, sensing the quantity of ink in said fountain, and regulating the application of the physical pressure applied to the exterior of said bag and doing so in accordance with the sensing.

13. The method of supplying ink to a printing press ink fountain as claimed in claim 12, including the steps of removing said bag from said container, removing the ink from said fountain, placing another bag of ink into said container, and applying pressure onto said another bag and directing the ink from said another bag to said fountain.

14. The method of supplying ink to a printing press ink fountain as claimed in claim 12, including applying the pressure to said bag by subjecting said bag to the force from a supply of pressurized air, and directing the flow of ink from said bag directly to said fountain in a manner free of causing the ink to move through any concuit.

15. An ink dispensing system for a printing press, comprising an ink fountain having an opening for receiving ink, a rigid container disposed above said fountain, a flexible bag of ink disposed in said container and having an ink-flow outlet, said ink-flow outlet of said bag being located directly above said fountain opening to supply ink to said fountain, a compressor including a piston in disposed in said container and being movable up and down in said container to be operative on said bag for compressing said bag within said container to cause the ink in said bag to flow through said outlet and into said fountain, a magnet on said piston, a magnet detector at the exterior of said container and being arranged to track said magnet and thereby display the elevation of said piston in said container for detecting the amount of ink in said bag, and a level sensor adjacent said fountain and being arranged to detect the level of ink in said fountain and being operatively arranged to control said compressor and thereby control the amount of ink flowing through said outlet and doing so in accordance with the level of ink in said fountain.

16. An ink dispensing system for a printing press, comprising an ink fountain having an upwardly facing opening for receiving ink, a rigid container having walls forming an enclosure and having an outlet opening directly above said fountain opening and disposed lowermost on said container on one of said walls for the passage of ink therethrough, a flexible bag of ink disposed in said enclosure and being upwardly supported on said one wall and being completely enclosed except for having an ink-flow outlet passageway disposed lowermost thereon to extend through said container outlet opening and be in ink-flow communication with said container outlet opening and directly above said fountain opening, a compressor arranged to form a portion of said enclosure and being disposed and arranged to force only on the exterior of said bag for forcing said bag against said container and thereby force ink to fall out of said bag through said bag passageway, and said bag passageway being disposed to have the falling ink enter said fountain opening.

17. The ink dispensing system for a printing press as claimed in claim 16 wherein said compressor is arranged and disposed to move toward said bag and reduce the volume of said enclosure when forcing on said bag to remove the ink therefrom.

18. The ink dispensing system for a printing press as claimed in claim 17 wherein said bag passageway is disposed at the lowermost extent of said bag and thereby is arranged to have the ink flow downwardly from said bag.

19. The ink dispensing system for a printing press as claimed in claim 16 wherein said bag includes an ink-flow outlet spout which defines said bag passageway and which extends through said container outlet opening.

20. A method for dispensing ink to a printing press ink fountain comprising the steps of arranging a flexible bag to be multi-sided and one endless and integral enclosure, except for having an ink-flow spout, and placing ink into the bag, placing the flexible bag of ink into a container having a wall and an ink-flow outlet and disposing said bag adjacent said wall and having said spout extend through said outlet, orienting said container and said bag to have said outlet and said spout being disposed lowermost on their respective selves to have the ink fall from said bag in a downward direction and directly into said fountain, and applying a physical force only to the exterior of only one side of said bag to force said bag against said wall in a manner to force the ink from said bag and through said spout and directing said ink to fall into said fountain by the force of gravity.

21. An ink dispensing system for a printing press, comprising an ink fountain having an opening for receiving ink, a rigid container disposed adjacent said fountain and having a plurality of sides with an outlet in one of said sides, a flexible bag of ink disposed in said container and having an ink-flow outlet section disposed relative to said container in an arrangement to have said outlet section in ink-flow with said container outlet and with said outlet section having an ink-flow passageway therethrough, said ink-flow outlet passageway of said bag being located relative to said fountain opening to supply ink to said fountain through said passageway, a compressor disposed in said container to be operative on said bag and being arranged for compressing said bag within said container and against said one side thereof to cause the ink in said bag to flow through said outlet and into said fountain, a level sensor adjacent said fountain and being arranged to detect the level of ink in said fountain and being operatively arranged to control said compressor and thereby control the amount of ink flowing through said outlet and doing so in accordance with the level of ink in said fountain, a pressurized air source and a pipe connected to said container for directing the compressed air for actuating said compressor, an electric solenoid valve in said pipe for controlling the flow of air therethrough, and said sensor and said solenoid valve electrically connected together and arranged for operating said solenoid valve in accord with the operation of said sensor.

22. An ink dispensing system for a printing press, comprising an ink fountain having an opening for receiving ink, a rigid container disposed adjacent said fountain and having a plurality of sides with an outlet in one of said sides, a flexible bag of ink disposed in said container and having an ink-flow outlet section disposed relative to said container in an arrangement to have said outlet section in ink-flow with said container outlet and with said outlet section having an ink-flow passageway therethrough, said ink-flow outlet passageway of said bag being located relative to said fountain opening to supply ink to said fountain through said passageway, a compressor disposed in said container to be operative on said bag and being arranged for compressing said bag within said container and against said one side thereof to cause the ink in said bag to flow through said outlet and into said fountain, a level sensor adjacent said fountain and being arranged to detect the level of ink in said fountain and being operatively arranged to control said compressor and thereby control the amount of ink flowing through said outlet and doing so in accordance with the level of ink in said fountain, an air valve and a supply of compressed air applicable on said valve, said compressor being arranged to be responsive to compressed air applied thereto, a solenoid valve operatively connected with both said air valve and said sensor, and an air passageway extending between said air valve and said compressor and being arranged for passing compressed air to said air-responsive compressor for pressing on said bag.

23. The ink dispensing system for a printing press, as claimed in claim 22, wherein said container includes air-tight seals for confining the compressed air in said container and thereby compress said bag.

24. The ink dispensing system for a printing press as claimed in claim 22, wherein said bag is arranged in said container to confine the ink free of contacting said container.

25. The ink dispensing system for a printing press as claimed in claim 22, wherein said container includes a door providing interior access to said container for removal and insertion of said bag.

* * * * *